US008514134B2

(12) United States Patent
Kim et al.

(10) Patent No.: US 8,514,134 B2
(45) Date of Patent: Aug. 20, 2013

(54) MIMO ANTENNA HAVING PARASITIC ELEMENTS

(75) Inventors: Chan Ho Kim, Incheon-shi (KR); Jin Myung Kim, Seongnam-shi (KR); Chang-Gyu Choi, Incheon-shi (KR); Gyoung Rok Beak, Siheung-shi (KR); Young Hun Park, Cheongju-shi (KR); Heung Ju Ahn, Suwon-shi (KR); Yeon Ho Yang, Goyang-shi (KR)

(73) Assignee: Mobitech Corp., Seoul (KR)

( * ) Notice: Subject to any disclaimer, the term of this patent is extended or adjusted under 35 U.S.C. 154(b) by 244 days.

(21) Appl. No.: 13/202,589

(22) PCT Filed: Oct. 19, 2009

(86) PCT No.: PCT/KR2009/006003

§ 371 (c)(1),
(2), (4) Date: Aug. 22, 2011

(87) PCT Pub. No.: WO2010/098529

PCT Pub. Date: Sep. 2, 2010

(65) Prior Publication Data

US 2011/0298666 A1 Dec. 8, 2011

(30) Foreign Application Priority Data

Feb. 27, 2009 (KR) ..... 10-2009-0016593

(51) Int. Cl.
*H01Q 1/38* (2006.01)

(52) U.S. Cl.
USPC ..... 343/700 MS; 343/846

(58) Field of Classification Search
USPC ..... 343/700 MS, 829, 846, 815, 833, 343/834
See application file for complete search history.

(56) References Cited

U.S. PATENT DOCUMENTS

| | | | | |
|---|---|---|---|---|
| 4,401,988 | A * | 8/1983 | Kaloi | 343/700 MS |
| 5,382,959 | A * | 1/1995 | Pett et al. | 343/700 MS |
| 6,326,921 | B1 * | 12/2001 | Egorov et al. | 343/700 MS |
| 6,982,672 | B2 * | 1/2006 | Lin et al. | 343/700 MS |
| 7,187,328 | B2 * | 3/2007 | Tanaka et al. | 343/700 MS |
| 7,636,063 | B2 * | 12/2009 | Channabasappa | 343/700 MS |
| 8,072,384 | B2 * | 12/2011 | Morrow | 343/700 MS |

FOREIGN PATENT DOCUMENTS

| | | | |
|---|---|---|---|
| KR | 10-2006-0129910 | A | 12/2006 |
| KR | 10-0699472 | B1 | 3/2007 |
| KR | 10-2008-0028613 | A | 4/2008 |
| WO | 2008-131157 | A1 | 10/2008 |

OTHER PUBLICATIONS

International Search Report for International Application No. PCT/KR2009/006003.

* cited by examiner

*Primary Examiner* — Tho G Phan
(74) *Attorney, Agent, or Firm* — LRK Patent Law Firm

(57) ABSTRACT

A Multiple-Input Multiple-Output (MIMO) antenna having parasitic elements is provided. The MIMO antenna includes a plurality of antenna elements, a plurality of parasitic elements, and a bridge. The plurality of antenna elements is symmetrically disposed on one side surface of a board while maintaining a predetermined distance therebetween. The plurality of parasitic elements is disposed on the other side surface of the board in a one-to-one correspondence with the plurality of antenna elements. The bridge is formed of a metal pattern line, and is configured to connect the plurality of parasitic elements to each other.

6 Claims, 12 Drawing Sheets

MIMO ANTENNA HAVING PARASITIC ELEMENTS

CROSS REFERENCE TO RELATED APPLICATION

This application is a National Stage of International Application No. PCT/KR2009/006003 filed Oct. 19, 2009, claiming priority based on Korean Patent Application No. 10-2009-0016593 filed Feb. 27, 2009, the content of which is incorporated herein by reference in its entirety.

TECHNICAL FIELD

The present invention relates generally to a Multiple-Input Multiple-Output (MIMO) antenna having parasitic elements, and more particularly, to a MIMO antenna having parasitic elements which includes a plurality of parasitic elements disposed in a one-to-one correspondence with a plurality of antenna elements and a bridge configured to connect the parasitic elements to each other, thereby improving the degree of isolation of each of the antenna elements and diversifying the circuit configuration and design implementation.

BACKGROUND ART

FIGS. 1 and 2 are diagrams showing the construction of conventional Multiple-Input Multiple-Output (MIMO) antennas. Each of a plurality of antenna elements 10 that constitutes a conventional MIMO antenna includes a radiator 11 and a feed point 12, and is connected to a ground surface 13. Since a conventional MIMO antenna, in which a plurality of antenna elements are arranged and which performs multiple input/output operations, is mounted in a small-sized mobile communication terminal, the distance between the antenna elements must be short, in which case electromagnetic waves radiated from the antenna elements cause mutual interference. The conventional MIMO antennas that have been devised to overcome this problem are designed to improve the degree of isolation. This has been done by ensuring there is sufficient distance between the feed points 12 of the antenna elements 10, as shown in FIG. 1, or alternatively, by forming slits 14 corresponding to 0.25λ of a frequency band for which the degree of insulation is desired to be improved in the ground surface 20 to which the antenna elements 10 are connected, as shown in FIG. 2. The results are that the flow of current components is directed to the slits 14 formed in the portion of the ground surface 13 below the space between the antenna elements 10, thereby reducing mutual interference of electromagnetic waves.

However, since the technology used to construct the above-described conventional MIMO antenna reduces the degree of insulation if a sufficient distance is not ensured, unlike that of FIG. 1, a distance equal to or longer than a predetermined distance must always be secured. Currently, the appropriate distance between the antenna elements 10 of a typical MIMO antenna is equal to or longer than 0.5λ.

Furthermore, in the case where in order to overcome the problem of the antenna of FIG. 1, the slots 14 are formed in the ground surface 13, as shown in FIG. 2, it is difficult to mount part of another element in the area of the ground surface 13 where the slots 14 are formed. Also, the location where part of another element can be mounted cannot be freely selected, so there are problems in that circuit configuration and design implementation are limited and are not flexible.

DISCLOSURE OF INVENTION

Technical Problem

Accordingly, the present invention has been made keeping in mind the above problems occurring in the prior art, and an object of the present invention is to provide a MIMO antenna which includes a plurality of parasitic elements attached to one side surface of a board in a one-to-one correspondence with a plurality of antenna elements disposed on the other side surface of the board and a bridge configured to connect the parasitic elements to each other, so that current components affecting the feed points of the plurality of antenna elements are directed to the bridge, thereby improving the degree of isolation of each of the plurality of antenna elements.

Another object of the present invention is to provide a MIMO antenna in which even in the case of an antenna in which each of a plurality of antenna elements has multiple bands, the antenna element provides an effective and improved degree of isolation for each frequency band, so that adjacent antenna elements can be operated independently without interference, even though the adjacent antenna elements are operated using the same type of signals, thereby reducing the distance between the antenna elements and diversifying circuit configuration and design implementation.

Solution to Problem

In order to accomplish the above objects, the present invention provides a MIMO antenna having parasitic elements, including a plurality of antenna elements symmetrically disposed on one side surface of a board while maintaining a predetermined distance therebetween; a plurality of parasitic elements disposed on the other side surface of the board in a one-to-one correspondence with the plurality of antenna elements; and a bridge formed of a metal pattern line, and configured to connect the plurality of parasitic elements to each other.

Advantageous Effects of Invention

According to the present invention, there is the effect of providing a MIMO antenna which includes the plurality of parasitic elements attached to one side surface of the board in a one-to-one correspondence with the plurality of antenna elements disposed on the other side surface of the board and the bridge configured to connect the parasitic elements to each other, so that current components affecting the feed points of the plurality of antenna elements are directed to the bridge, thereby improving the degree of isolation of each of the plurality of antenna elements.

Furthermore, there is the effect of providing a MIMO antenna in which even in the case of an antenna in which each of a plurality of antenna elements has multiple bands, the antenna element provides an effective and improved degree of isolation for each frequency band, so that adjacent antenna elements can be operated independently without interference, even though the adjacent antenna elements are operated using the same type of signals, thereby reducing the distance between the antenna elements and diversifying circuit configuration and design implementation.

BRIEF DESCRIPTION OF DRAWINGS

The above and other objects, features and advantages of the present invention will be more clearly understood from the following detailed description taken in conjunction with the accompanying drawing, in which.

MODE FOR THE INVENTION

Preferred embodiments of the present invention will be described in detail below with reference to the accompanying drawings.

Figure 1:
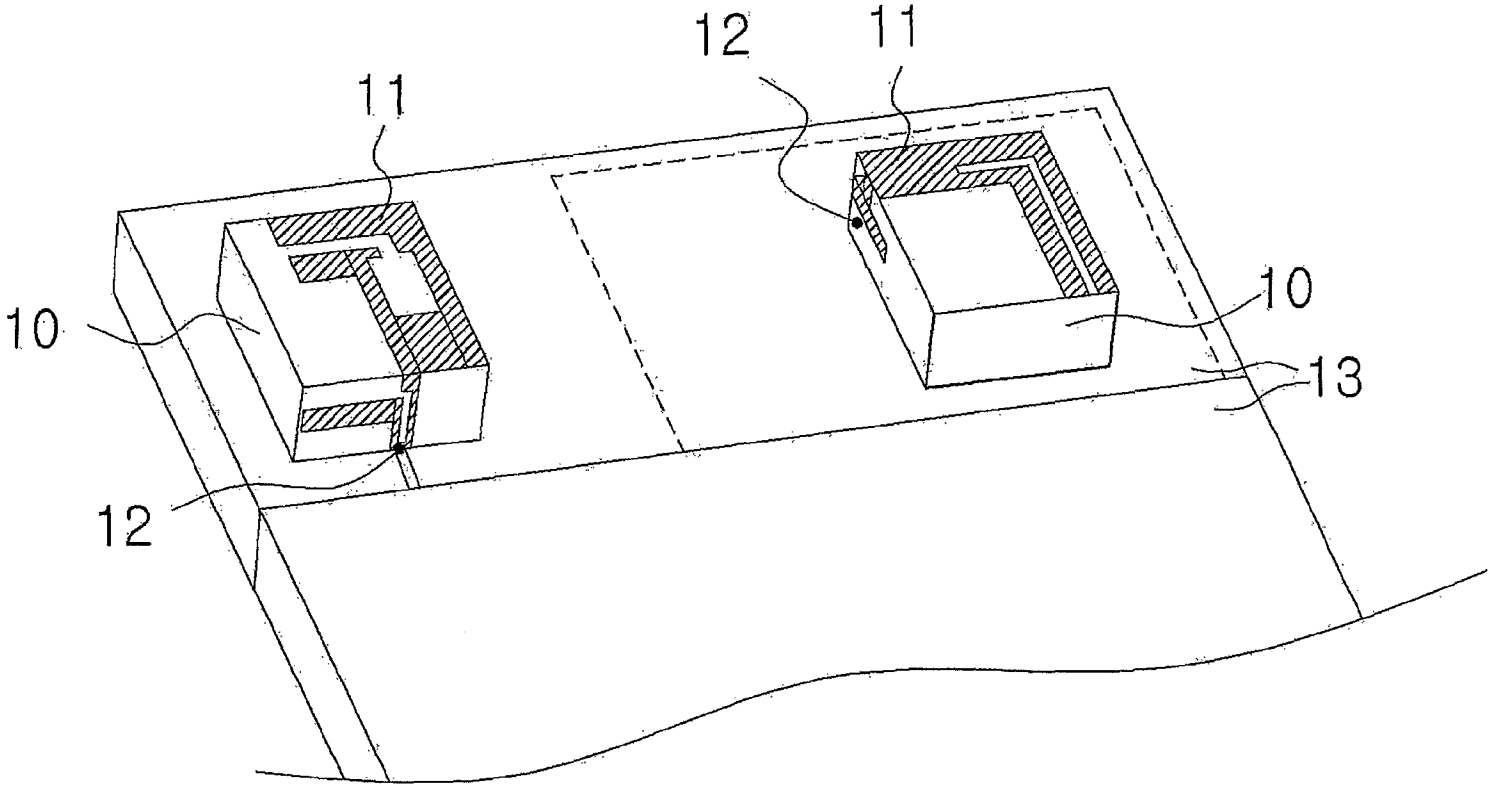
FIGS. 1 and 2 are diagrams showing the construction of conventional MIMO antennas.
Figure 2:
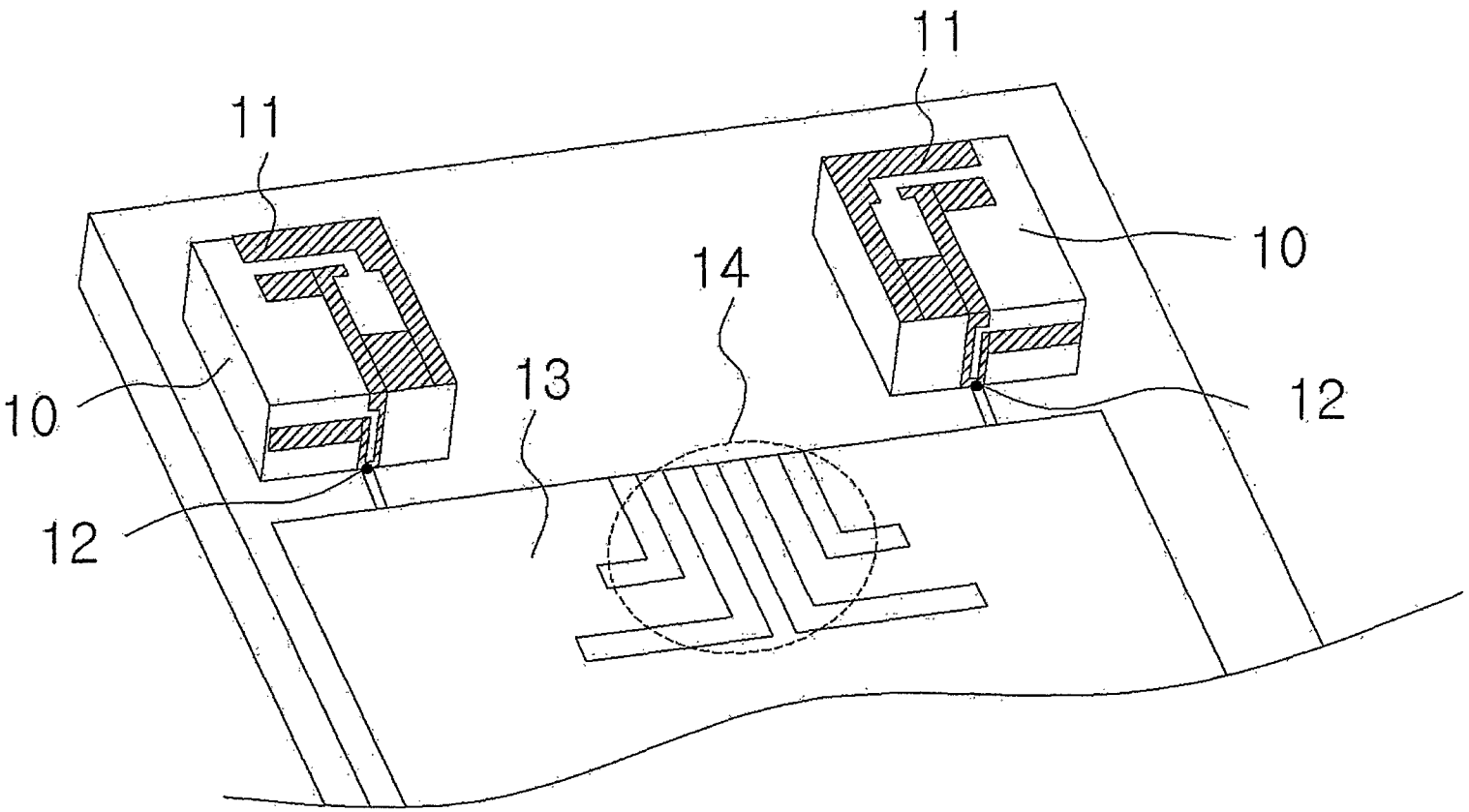
Figure 3:
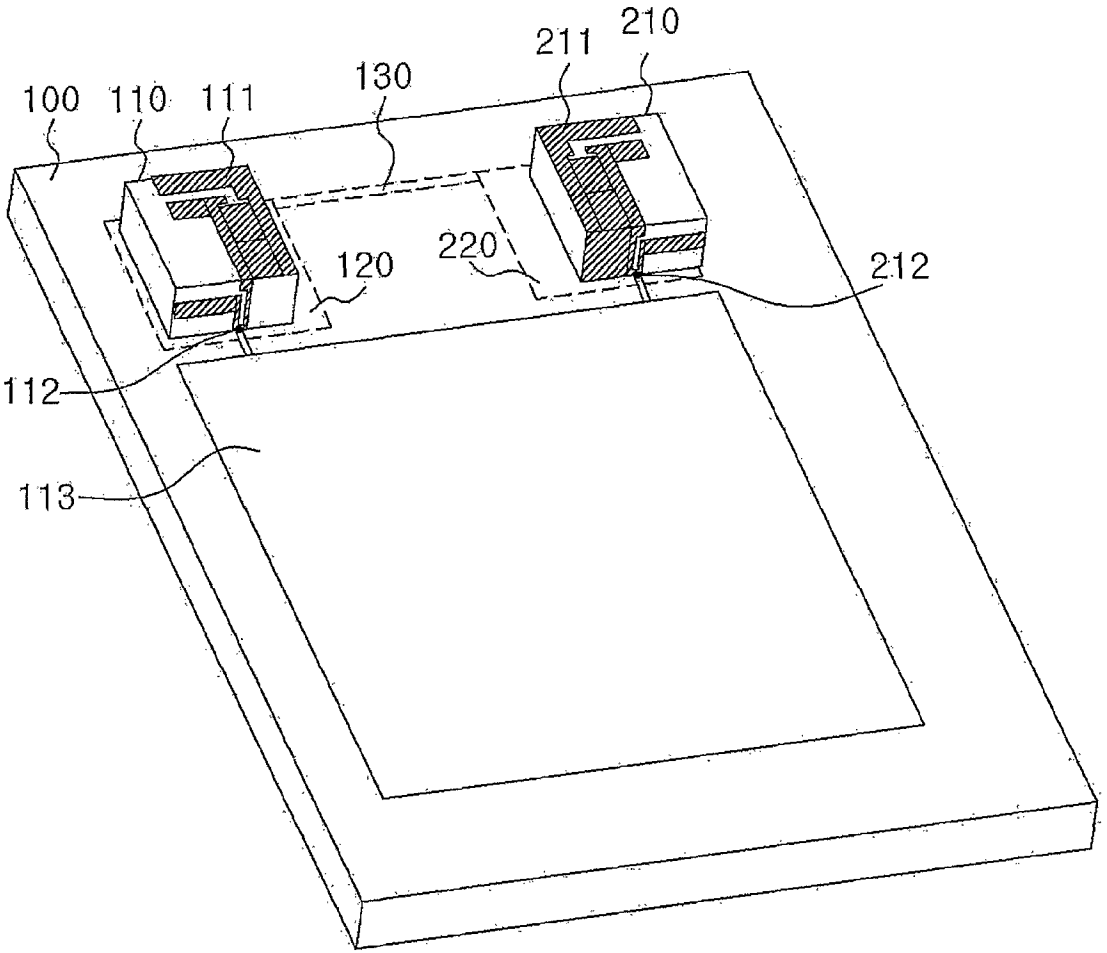
FIG. 3 is a diagram showing the construction of a MIMO antenna according to an embodiment of the present invention.

FIG. 3 is a diagram showing the construction of a MIMO antenna according to an embodiment of the present invention.

The MIMO antenna having parasitic elements according to the embodiment of the present invention includes first and second antenna elements 110 and 210 disposed on one side surface of a board 100, a plurality of parasitic elements 120 and 220 disposed on the other side surface of the board 100, and a bridge 130 configured to connect the plurality of parasitic elements 120 and 220 to each other.

In greater detail, the first and second antenna elements 110 and 210 are symmetrically disposed at a predetermined interval. Each of the first and second antenna elements 110 and 210 includes a radiator 111 or 211 disposed in a predetermined pattern and a feed point 112 or 212 configured to feed the first or second antenna element 110 or 210 by feeding signals to the radiator 111 or 211. A metallic plate-shaped ground surface 113 is further provided on the board 100.

Furthermore, the first and second antenna elements 110 and 210 are antenna elements which can normally operate in all of the bands required by IEEE 802.11 and 802.16 standards.

In greater detail, the first and second antenna elements 110 and 210 acquire frequency bands in which triple resonance occurs and also acquire the radiation performance and bandwidth required for the service of each frequency band, using the branch line technique.

Figure 4:
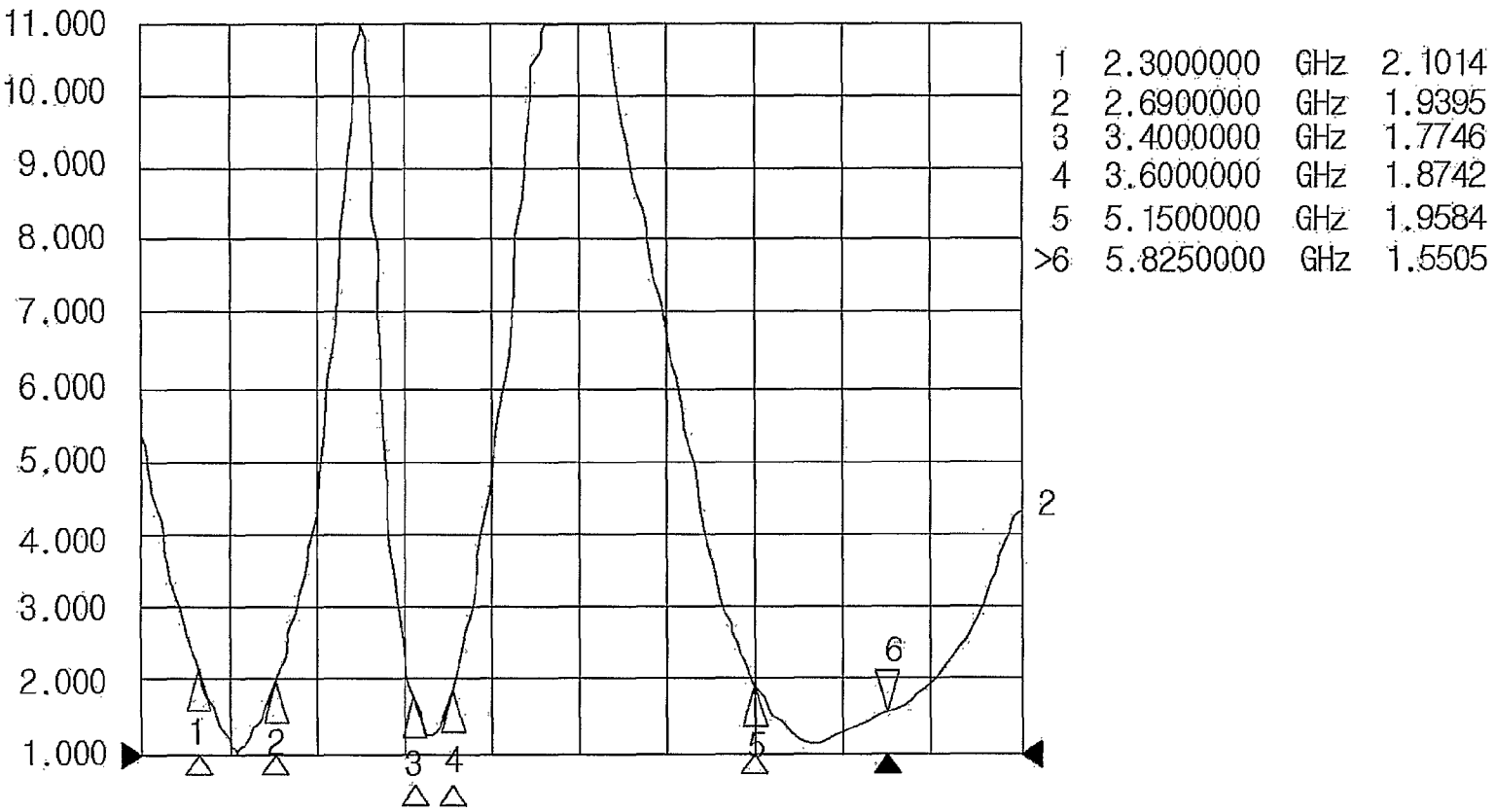
FIGS. 4 and 5 are graphs showing the standing wave ratios of respective antenna elements according to the embodiment of the present invention.
Figure 5:
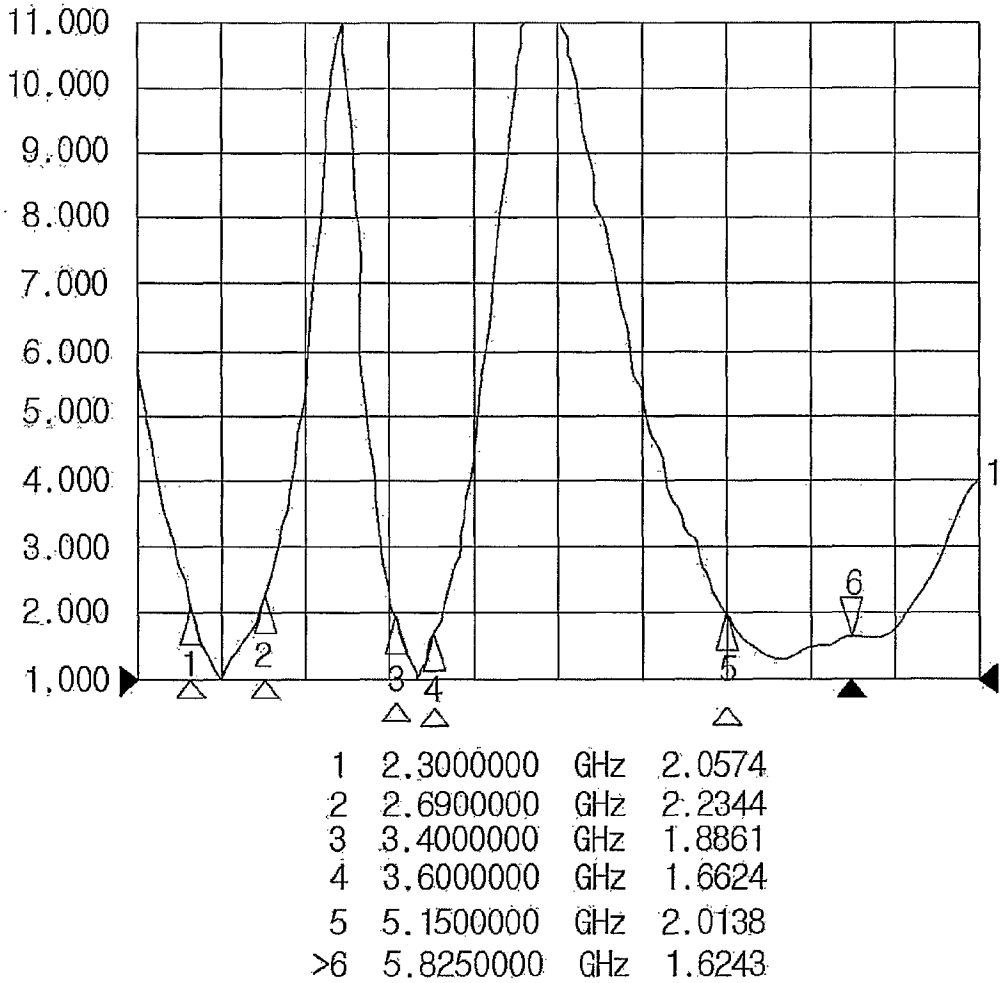

The standing wave ratios of the first and second antenna elements 110 and 210 at which triple resonance occurs are shown in FIGS. 4 and 5 in the form of graphs.

As shown in the graphs, the first and second antenna elements 110 and 210 resonate in triple resonance frequency bands including resonance frequencies of 2.5 GHz, 3.5 GHz and 5.5 GHz.

Although the present invention is described by a MIMO antenna in which the first and second antenna elements 110 and 210 resonate in multiple frequency bands as in the embodiment described above, the present invention may be applied to an antenna having a plurality of antenna elements, including a MIMO antenna in which first and second antenna elements 110 and 210 resonate in a single frequency band.

Figure 6:
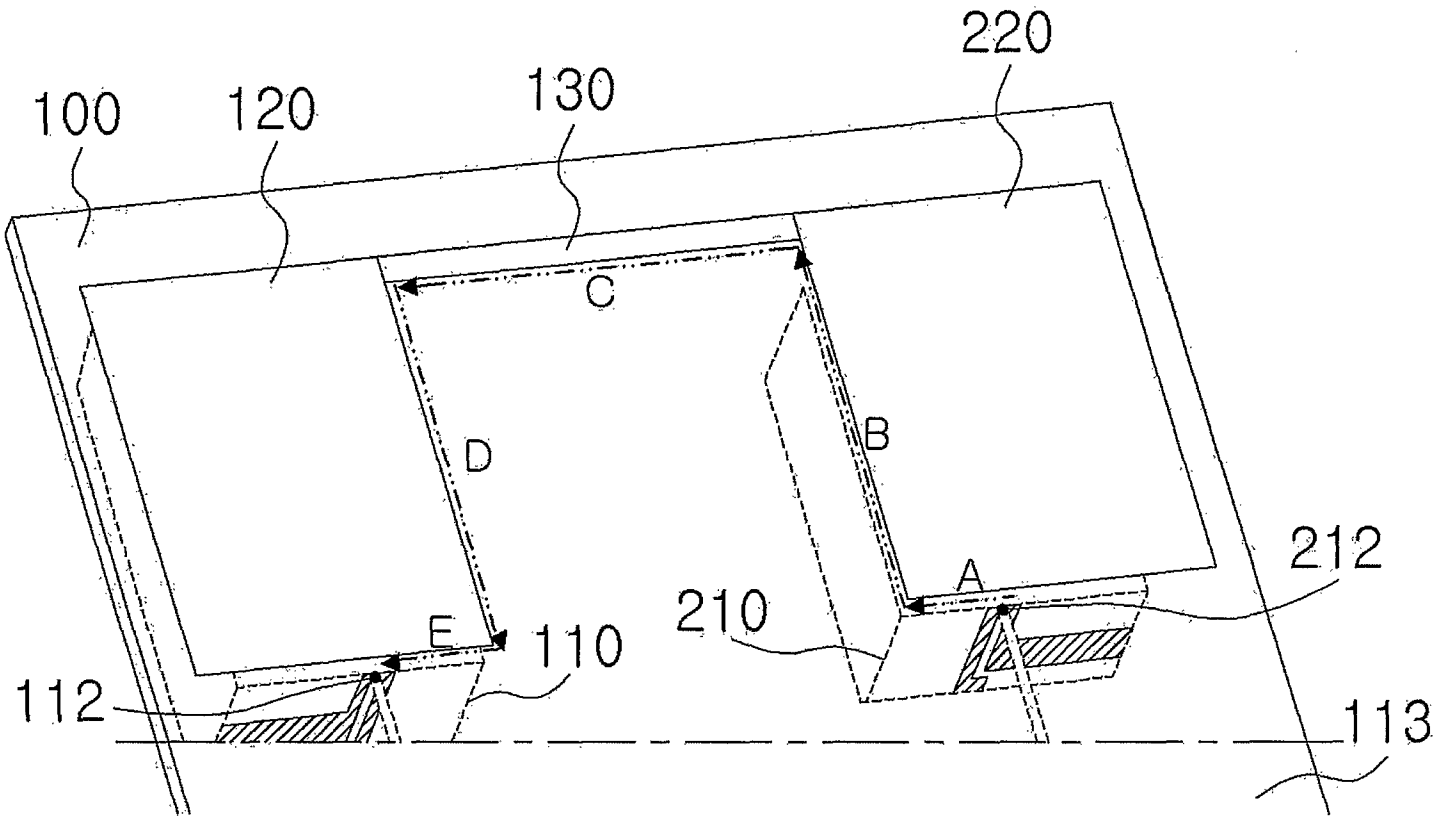
FIG. 6 is a rear view of the MIMO antenna according to the embodiment of the present invention.

As shown in FIG. 6, the parasitic elements 120 and 220 are formed of metal plates on the other side surface of the board 100 which are attached to the rear surfaces of the first and second antenna elements 110 and 210 in a one-to-one correspondence.

Each of the parasitic elements 120 and 220 according to the embodiment of the present invention is configured to have an area larger than that of the rear surface of the corresponding first and second antenna elements 110 and 210 on the other side surface of the board 100.

Furthermore, the parasitic elements 120 and 220 are formed so as to be spaced apart from the ground surface 113.

Accordingly, the parasitic elements 120 and 220 in a one-to-one correspondence with the first and second antenna elements 110 and 210 are first used to stabilize resonance occurring in the first and second antenna elements 110 and 220.

Furthermore, the parasitic elements 120 and 220 are mutually coupled to the first and second antenna elements 110 and 210.

The bridge 130 is formed by connecting the parasitic elements 120 and 220 to each other using a metal pattern line with a predetermined width.

Furthermore, the bridge 130 directs current components generated through the mutual coupling between the first and second antenna elements 110 and 210 and the parasitic elements 120 and 220.

Accordingly, due to the coupling phenomenon, current components flow to the parasitic elements 120 and 220 and flow along the edge of the ground surface 113. Current components affecting the feed points 112 and 212 of counterparty antenna elements and current components flowing to the parasitic elements 120 and 220 are all directed in a direction where the bridge 130 has been disposed, so that current components affecting the feed points 112 and 212 of the counterparty antenna elements cancel each other thanks to the bridge 130, thereby improving the degree of isolation between the first and second antenna elements 110 and 210.

Since the bridge 130 is electrically connected to the parasitic elements 120 and 220, the bridge 130 and the parasitic elements 120 and 220 operate like a single parasitic element.

Here, the bridge 130 functions to electrically connect the parasitic elements 120 and 220 to each other, and functions to adjust the length to 0.51 of a frequency band for which the degree of isolation is intended to be improved.

In an embodiment of the present invention, a length corresponding to 0.51 of a frequency band for which the degree of isolation is intended to be improved is identical to the length of the path of current components flowing between the feed points 112 and 212 when the first and second antenna elements 110 and 210 are operated.

Accordingly, the bridge 130 connecting the parasitic elements 120 and 220 to each other has a length corresponding to path C selected from among paths A, B, C, D and E representing the paths of current components flowing between the feed points 112 and 212 when the second antenna element of FIG. 6 is operated. This length is identical to a length obtained by subtracting the sum of paths A, B, D and E from 0.5λ of a frequency band for which the degree of isolation is intended to be improved.

For example, the length of the bridge is C=0.5λ−(A+B+D+E).

The length of the bridge affects the distance between the first and second antenna elements 110 and 210. The appropriate distance between the first and second antenna elements 110 and 210 according to an embodiment of the present invention is reduced to 0.2λ, 0.29λ and 0.45λ for resonance frequencies of 2.5 GHz, 3.5 GHz and 5.5 GHz, respectively.

As described above, the bridge 130 adjusts the distance between adjacent first and second antenna elements 110 and 210.

As a result, a spatial arrangement for the circuit configuration and design implementation of the MIMO antenna having parasitic elements according to the present invention becomes flexible.

In order to illustrate the operational characteristics of the present invention, the variations in the flow of current components are divided into the cases occurring before and after the embodiment of the present invention has been applied, and these cases will be described below.

Figure 7:
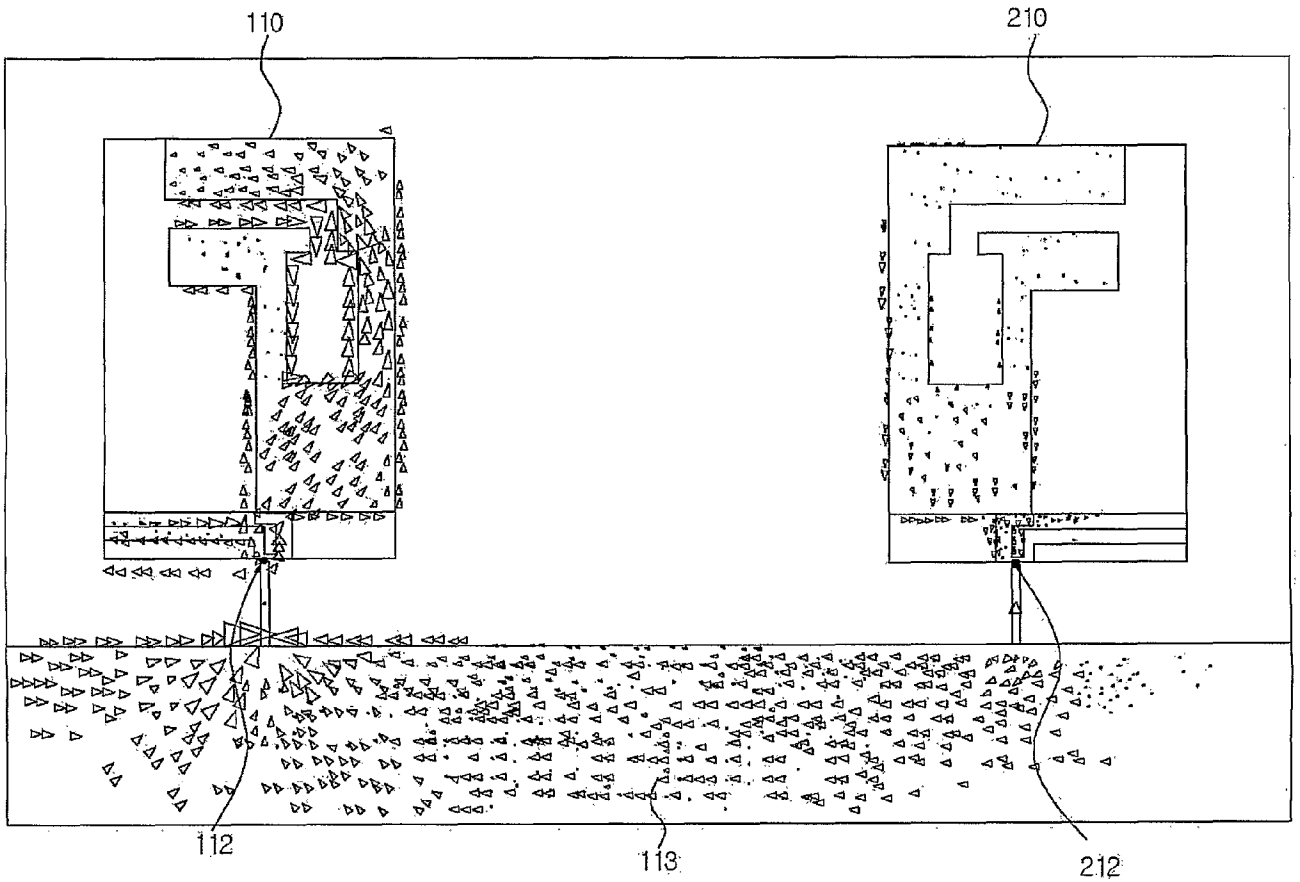
FIG. 7 is a diagram showing the flow of current components through the MIMO antenna when a first antenna element is operated before the embodiment of the present invention has been applied.
Figure 8:
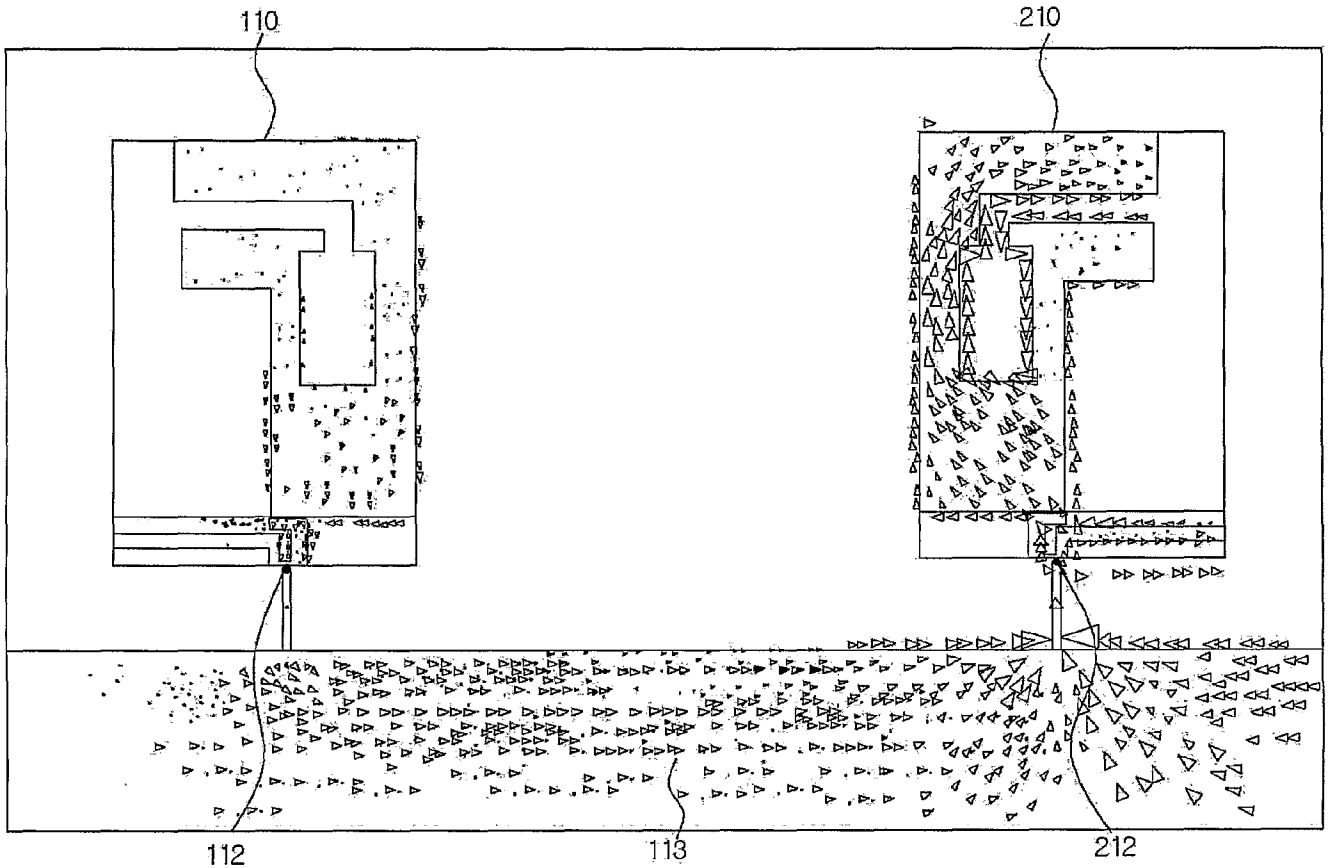
FIG. 8 is a diagram showing the flow of current components through the MIMO antenna when a second antenna element is operated before the embodiment of the present invention has been applied.

FIGS. 7 and 8 are diagrams showing the flow of current components through the MIMO antenna when the antenna elements are operated before the embodiment of the present invention has been applied.

As shown in FIG. 7, when the first antenna element 210 is operated, current components flow along the edge of the ground surface 113, thereby affecting the feed point 112 of the second antenna element 210. Meanwhile, as shown in FIG. 8, when the second antenna element 210 is operated, current components flow through the edge of the ground surface 113, thereby affecting the feed point 112 of the first antenna element 110.

Accordingly, when the antenna elements 110 and 210 are operated, the antenna elements 110 and 210 undergo mutual interference.

Figure 9:
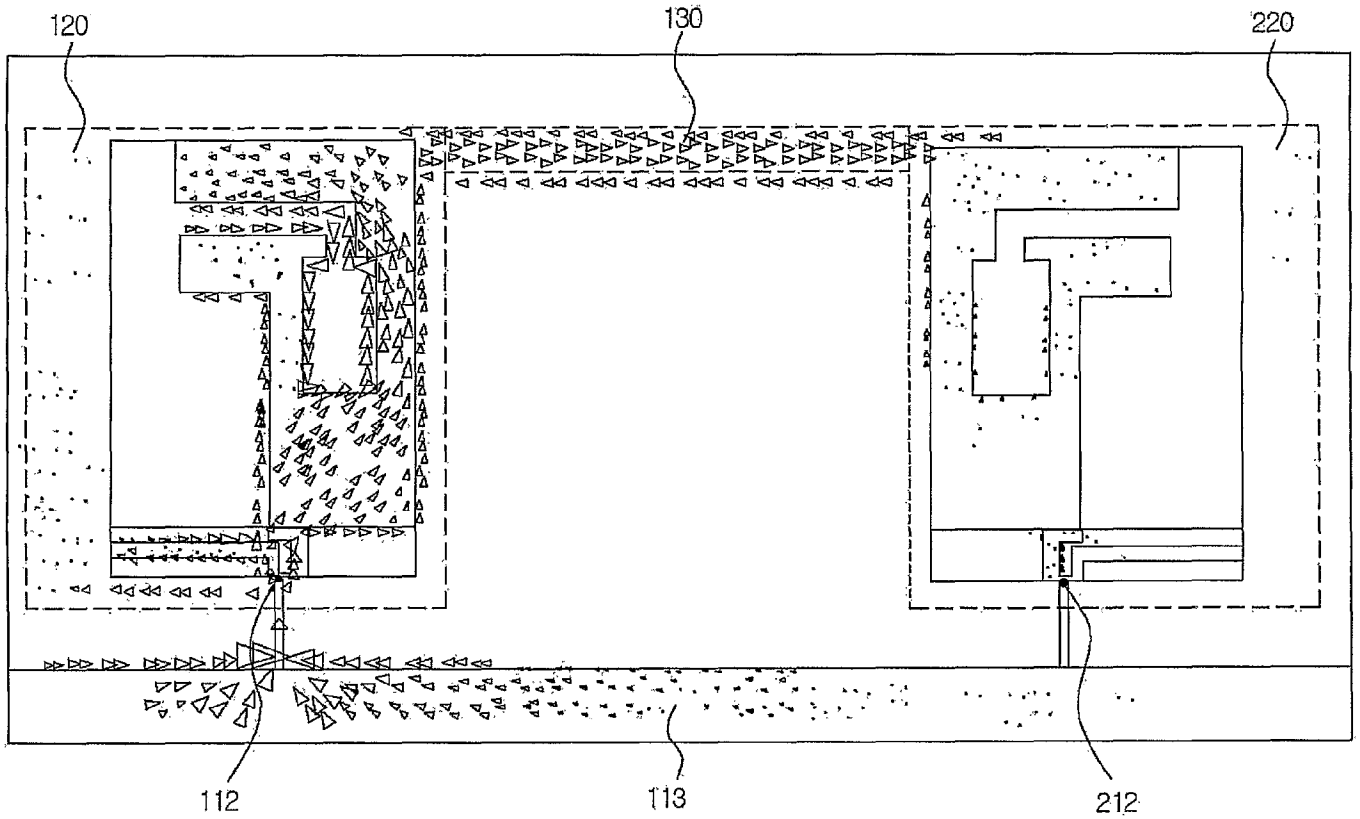
FIG. 9 is a diagram showing the flow of current components through the MIMO antenna when the first antenna element is operated after the embodiment of the present invention has been applied.
Figure 10:
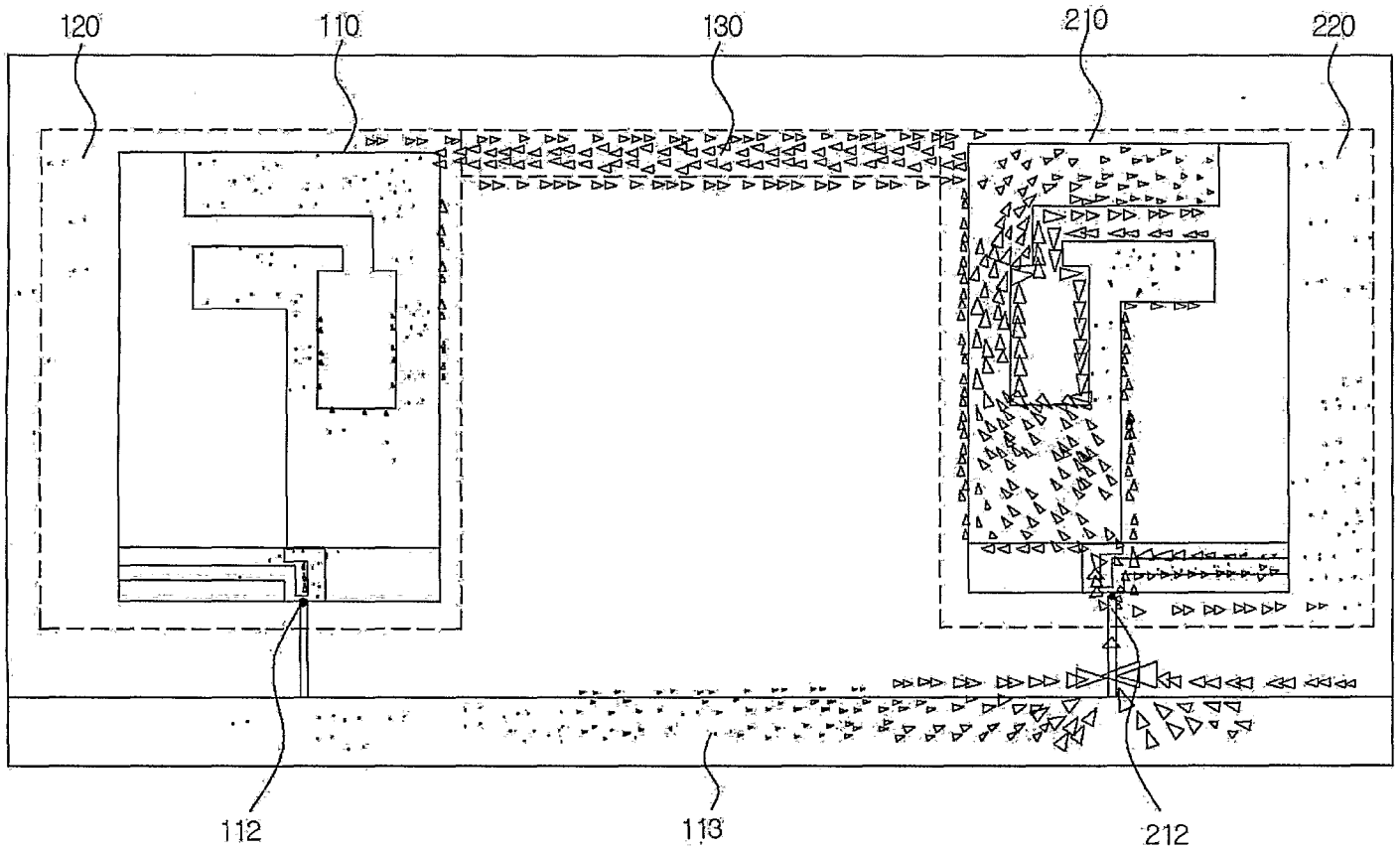
FIG. 10 is a diagram showing the flow of current components through the MIMO antenna when the second antenna element is operated after the embodiment of the present invention has been applied.

FIGS. 9 and 10 are diagrams showing the flow of current components through the MIMO antenna when the antenna elements are operated after the embodiment of the present invention has been applied.

As shown in FIG. 9, when the first antenna element 210 is operated, current components which affected the feed point 212 of the second antenna element 210 while flowing along the edge of the ground surface 113 are directed and flow in the direction where the bridge 130 has been disposed because the first antenna element 110 and the parasitic element 120 corresponding to the first antenna element 110 are mutually coupled to each other. Meanwhile, as shown in FIG. 10, when the second antenna element 210 is operated, current components which affected the feed point 112 of the second antenna element 110 while flowing along the edge of the ground surface 113 are directed and flow in the direction where the bridge 130 has been formed because the second antenna element 210 and the parasitic element 220 corresponding to the first antenna element 210 are mutually coupled to each other.

Accordingly, when each of the antenna elements 110 and 210 are operated, the bridge 113 cancels current components affecting the feed point of the counterpart antenna element.

As described above, thanks to the bridge 130, the antenna elements 110 and 210 do not affect each other, so that the degree of isolation between the antenna elements 110 and 210 is improved.

As described above, in the MIMO antenna to which the parasitic elements 120 and 220 and the bridge 130 have been applied according to the embodiment of the present invention, current components having affected the feed points 112 and 212 while flowing along the edge of the ground surface 113 are directed to the bridge 130 connecting the parasitic elements 120 and 220. Although the same type of signals having the same phase are applied to the feed points 112 and 212, the current components of the feed points 112 and 212 directed to the bridge 130 cancel each other. Accordingly, although the plurality of antennas is operated at the same time, the degree of isolation can be ensured, thereby enabling normal radiation.

Figure 11:
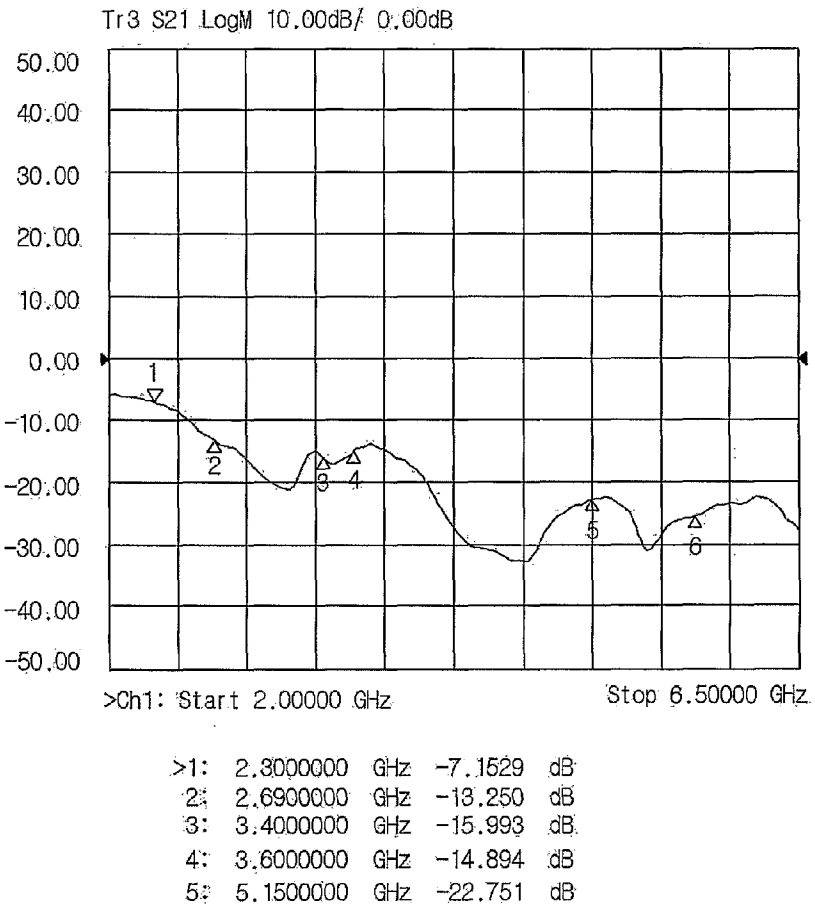
FIG. 11 is a graph showing the actual measured degrees of isolation before the parasitic elements and the bridge according to the embodiment of the present invention have been applied.
Figure 12:
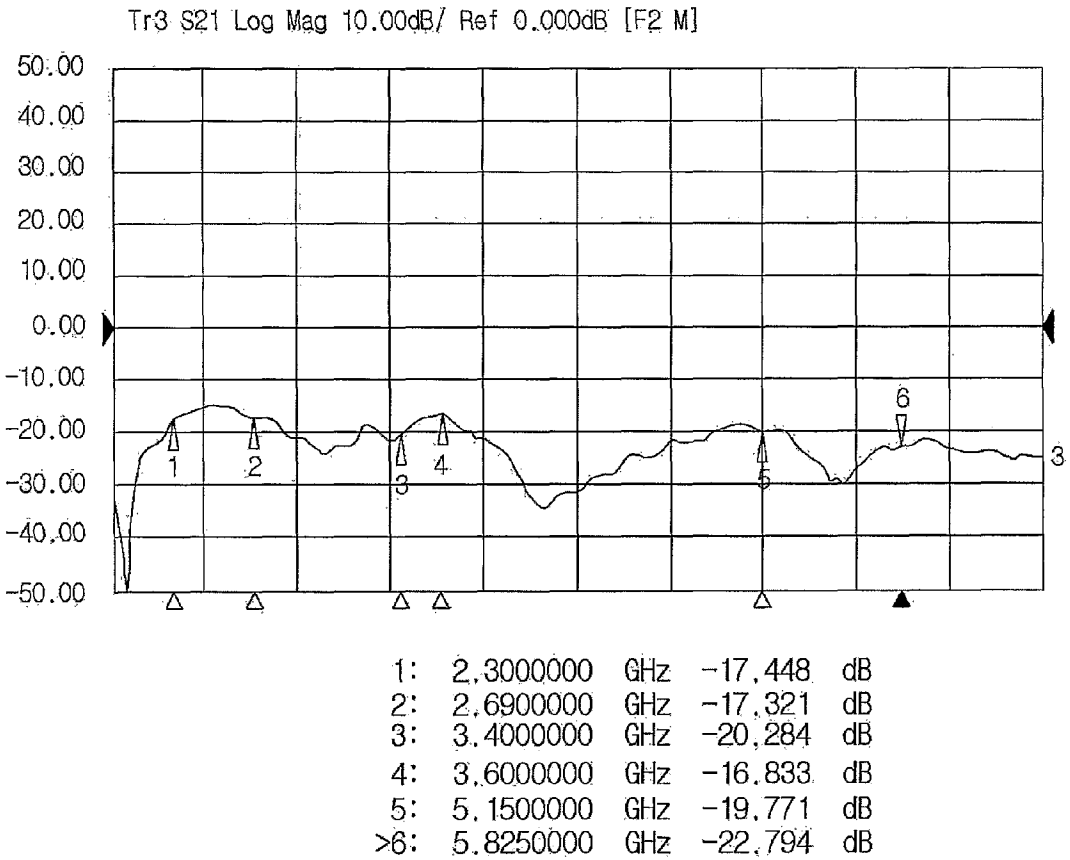
FIG. 12 is a graph showing the actual measured degrees of isolation after the parasitic elements and the bridge according to the embodiment of the present invention have been applied.

FIG. 11 is a graph showing the actual measured degrees of isolation before the parasitic elements 120 and 220 and the bridge 130 according to the embodiment of the present invention have been applied, and FIG. 12 is a graph showing the actual measured degrees of isolation after the parasitic elements 120 and 220 and the bridge 130 according to the embodiment of the present invention have been applied.

The optimally required degree of isolation of a frequency band occurring in each of the antenna elements 110 and 210 is equal to or greater than −15 dB.

As compared with the actual measured degrees of isolation illustrated in FIG. 11, the actual measured degrees of isolation after the parasitic elements 120 and 220 and the bridge 130 have been applied, and which is equal to or less than the optimally required degree of isolation, are relatively uniformly acquired over all of the frequency bands, as shown in FIG. 12.

As a result, the present invention has the effect of providing a MIMO antenna which includes the parasitic elements attached to one side surface of the board in a one-to-one correspondence with the antenna elements disposed on the other side surface of the board and the bridge configured to connect the parasitic elements to each other, so that current components affecting the feed points of the antenna elements are directed to the bridge, thereby improving the degree of isolation of each of the antenna elements.

In particular, the present invention has the effect of providing a MIMO antenna, in which even in the case of an antenna in which each of a plurality of antenna elements has multiple bands, the antenna element provides the effective and improved degree of isolation for each frequency band, so that adjacent antenna elements can be operated independently without interference even though the adjacent antenna elements are operated using the same type of signals, thereby reducing the distance between the antenna elements and diversifying circuit configuration and design implementation.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A Multiple-Input Multiple-Output (MIMO) antenna having parasitic elements, comprising:

a plurality of antenna elements symmetrically disposed on a first side surface of a board while maintaining a predetermined distance therebetween;

a plurality of parasitic elements disposed on a second side surface of the board in a one-to-one correspondence with the plurality of antenna elements; and a bridge formed of a metal pattern line, and configured to connect the plurality of parasitic elements to each other.

2. The MIMO antenna as set forth in claim 1, further comprising a ground surface formed of a metal plate on the board and spaced apart from the plurality of antenna elements and the plurality of parasitic elements.

3. The MIMO antenna as set forth in claim 1, wherein the plurality of antenna elements operates while resonating in a single frequency band or in multiple frequency bands.

4. The MIMO antenna as set forth in claim 1, wherein the plurality of antenna elements are mutually coupled to the plurality of parasitic elements, respectively, and the bridge cancels the current components directed through the coupling.

5. The MIMO antenna as set forth in claim 1, wherein the bridge adjusts a distance between adjacent antennas of the plurality of antenna elements.

6. The MIMO antenna as set forth in claim 1, wherein the plurality of antenna elements comprises respective feed points for feeding the antenna elements.

* * * * *